US006575312B2

(12) United States Patent
Santa Cruz et al.

(10) Patent No.: US 6,575,312 B2
(45) Date of Patent: Jun. 10, 2003

(54) SUPPORT BRACKET FOR GARDEN HOSE ATTACHMENTS

(76) Inventors: Cathy D. Santa Cruz, 7630 Tholl Dr., Reno, NV (US) 89506; Burt D. Imeson, 1926 Hillsboro Blvd., Fallon, NV (US) 89406; David W. Imeson, 1926 Hillsboro Blvd., Fallon, NV (US) 89406

( * ) Notice: Subject to any disclaimer, the term of this patent is extended or adjusted under 35 U.S.C. 154(b) by 0 days.

(21) Appl. No.: 09/954,991

(22) Filed: Sep. 17, 2001

(65) Prior Publication Data

US 2003/0052069 A1 Mar. 20, 2003

(51) Int. Cl.[7] ..... A47F 7/00

(52) U.S. Cl. ..... 211/70.6

(58) Field of Search ..... 211/70.6

(56) References Cited

U.S. PATENT DOCUMENTS

| | | | | | |
|---|---|---|---|---|---|
| 1,712,473 | A | * | 5/1929 | McWethy | 211/70.6 |
| 3,667,712 | A | * | 6/1972 | Furgueson | 248/75 |
| 5,228,570 | A | * | 7/1993 | Robinson | 211/70.6 |
| D340,827 | S | * | 11/1993 | Hubbard | D6/567 |
| 5,398,823 | A | * | 3/1995 | Anders | 211/70.6 |
| 5,499,724 | A | * | 3/1996 | Hickman | 211/70.6 |
| 5,501,342 | A | * | 3/1996 | Geibel | 211/70.6 |
| 5,704,496 | A | * | 1/1998 | Latta | 211/70.6 |
| 5,813,550 | A | * | 9/1998 | Sheehan et al. | 211/87.01 |
| 5,975,297 | A | * | 11/1999 | Kao | 206/378 |
| 6,145,662 | A | * | 11/2000 | Newton | 211/70.6 |
| 6,431,373 | B1 | * | 8/2002 | Blick | 211/70.6 |
| 2001/0001197 | A1 | * | 5/2001 | Ramsey et al. | 211/70.6 |

* cited by examiner

*Primary Examiner*—Daniel P. Stodola
*Assistant Examiner*—Erica B Harris

(57) ABSTRACT

An elongated support member having upraised attachment plugs for threadably yet removably receiving various types of garden hose attachments thereon.

1 Claim, 1 Drawing Sheet

SUPPORT BRACKET FOR GARDEN HOSE ATTACHMENTS

FIELD OF THE INVENTION

This invention relates in general to support brackets but more particularly pertains to a support bracket that is especially useful for storage of garden hose attachments, such as spray nozzles, etc. The bracket is portable and can be easily mounted at a location of user choice, such as on a fence or the like. Also, this bracket allows a user to easily insert or disengage such accessories in a quick and efficient manner.

BACKGROUND OF THE INVENTION

It is well known that there are many different types of garden hose attachments available in today's market such as spray nozzles, sprinklers, spray wands, hose bibs, and the like. Yet these are generally designed for a specific use and are not functional for dual purposes. Thus, most individuals who engage in yard work or other similar chores, which typically include use of a garden hose, require multiple accessories. Unfortunately, these accessories tend to be most cumbersome and difficult to store and/or transport, and this presents a great need for a convenient means for storage and transport of such items. However, there currently is not such a means available on the market and nowhere in the known prior art did the applicants find any suitable reference which could be easily used for this purpose.

Some of the known related prior art includes the following U.S. Pat. No. 444,328, entitled "HOLDER FOR WASHERS", U.S. Pat. No. 3,667,712 entitled "NOZZLE STORAGE UNIT" and U.S. Pat. No. 5,813,550 entitled "STORAGE RACK WITH THREADED PEGS". Each of which are functional for their intended use, but none could be used as a storage means for hose attachments, as taught within the present invention. The '712 reference is functional for slidably attaching a spray nozzle onto the actual hose member, but this is very inconvenient as the attachment fits loosely on the hose and would tend to slide thereon. Also, this attachment is only functional for support of one hose fitting and is therefore very limited in actual use.

The '328 and '550 references are only cited because they are used for storage of various articles such as washers or other circular items, which can be slidably engaged onto a support structure. However, even if modified these devices could not be used for the purpose of the present invention.

Therefore, the applicants contend there is a real need for a suitable device which resolves the afore mentioned problem, and thus we herein provide a new and unique way to store and/or transport hose attachments in a manner which heretofore has not been taught within the known prior art.

SUMMARY OF THE INVENTION

It is therefore an object of the present invention to provide a support bracket for garden hose attachments which is simple in construction, affordable to manufacture, and which fulfills a great need that has not been previously addressed.

It is a further object of the present invention to provide a support bracket for garden hose attachments, which depending on the embodiment, can either threadably receive such accessories thereon in a fixed position, or such accessories after being threadably engaged can be slidably positioned into a location of user choice.

It is another object of the present invention to provide a support bracket for garden hose attachments which can be made from substantially any suitable material of choice, such as wood, plastic, aluminum, steel, etc.

Yet a further object of the present invention is to provide a support bracket for garden hose attachments which is portable, and/or can be fixedly attached onto a support structure, such as a fence, or the like.

Also another object of the present invention is to provide a support bracket for garden hose attachments which is weather-proof and very durable.

Still a further object of the present invention is to provide a support bracket for garden hose attachments that can be used with substantially any type of hose accessory which is typically attached onto a garden hose fitting.

Another object of the present invention is to provide a support bracket for garden hose attachments which is functional for receiving and supporting substantially any style or various size of garden hose accessory, respectively.

Other objects and advantages will be seen when taken into consideration with the following drawings and specification.

DETAILED DESCRIPTION OF THE DRAWINGS

Referring now in detail to the drawings wherein like characters refer to like elements throughout the various views. As illustrated within FIGS. 1 & 2, (10) is substantially an overview for the present invention which is a support bracket for garden hose attachments and which is of very simple construction.

Figure 1:
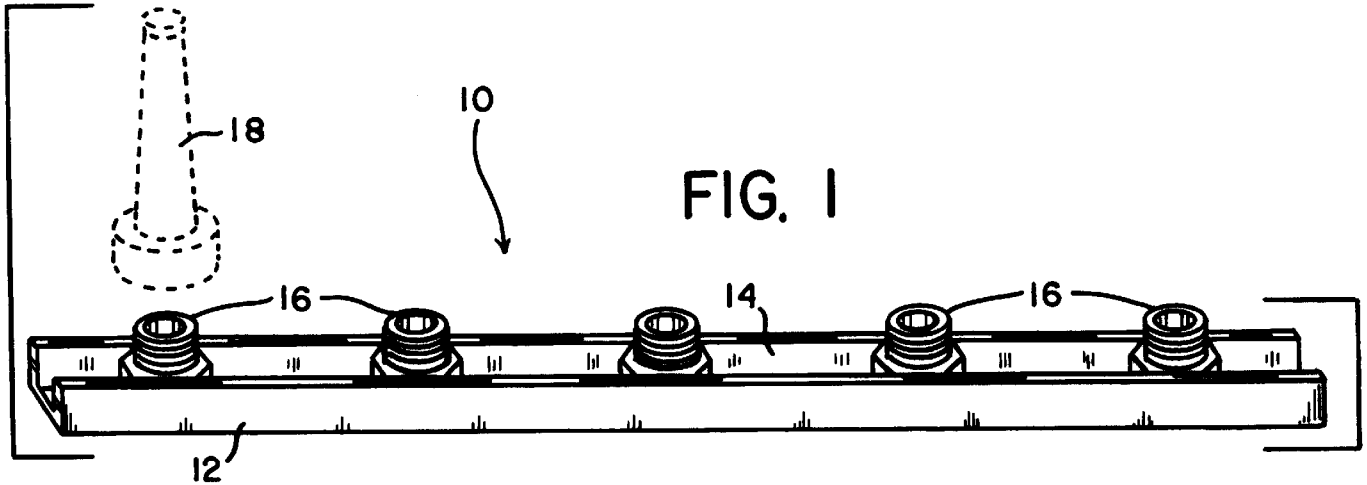
FIG. 1 is substantially a perspective overview of the preferred embodiment for the present invention.

Within the preferred embodiment, as illustrated in FIG. 1, support bracket (10) consists of an elongated support member (12) having upraised side walls running lengthwise which form an elongated channel (14), and elongated channel (14) being of a suitable shape and size to slidably receive and retain multiple externally threaded attachment plugs (16) therein, respectively. Whereby, it can clearly be seen that support bracket (10) with externally threaded attachment plugs (16) in combination can threadably receive and slidably support multiple internally threaded garden hose attachments of various types thereon, such as the spray nozzle (18) which is depicted in ghost lines.

It is to be noted only one type of spray nozzle is depicted herein but many different types of garden hose attachments may be stored simultaneously thereon. It is to be further noted that this embodiment is most efficient as each of the garden hose attachments can be easily slidably positioned into a location of user choice. Thus, allowing different types and sizes of attachments to be easily supported without being limited to a confined space and this further eliminating possible collision between each of the attachments.

It is to be understood that the elongated support member (12) of the preferred embodiment as depicted in FIG. 1 may also be easily manufactured, such as from a plastic mold injection, or if preferred it may be formed from other suitable materials, such as metal, aluminum, wood, etc.

It is to be further understood that each of the externally threaded attachment plugs (16) can be of any suitable shape or size of engineering choice, such as the attachment plugs typically known as ¾ PVC plugs, but the applicants prefer that each plug have either a hexagonal or square shaped base. This is very important, as it will not allow the plugs to accidentally rotate and become disengaged when the garden hose attachment is threadably removed there from.

Figure 2:
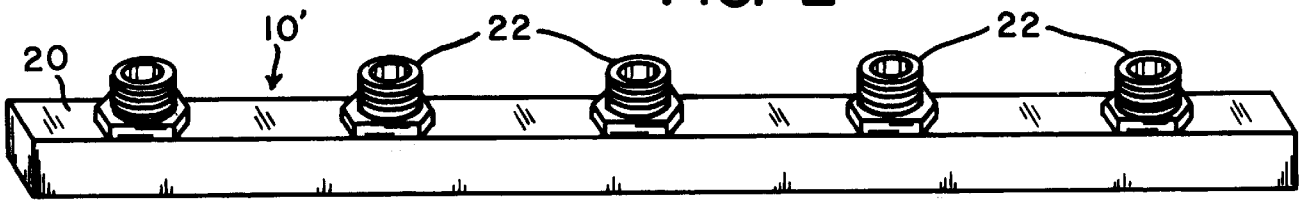
FIG. 2 is substantially a perspective overview of a second embodiment for the present invention.

Referring now to FIG. 2, which substantially illustrates a second embodiment for the present invention. Wherein the support bracket (10') consists of an elongated support member (20) having multiple spaced apart protruding externally threaded attachment plugs (22) fixedly attached thereon. Whereby it can clearly be seen that elongated support member (20) with externally threaded attachment plugs (22) in combination can threadably receive and support multiple internally threaded garden hose attachments of various types thereon.

It is to be also understood that the embodiment of FIG. 2 can also be easily manufactured from a plastic mold injection, including each of the externally threaded attachment plugs (22). Thus, the entire support bracket (10') can be formed as one complete unit. Although if preferred, each of the externally threaded attachment plugs (22) can be fixedly attached onto elongated support member (20) by any other suitable attachment means of engineering choice.

Figure 3:
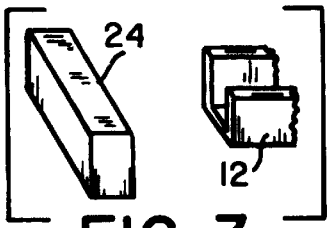
FIG. 3 is substantially a perspective plan view of an end cap which may be used as an option for the present invention.

Referring now to FIG. 3, which substantially depicts a variation of the embodiment of FIG. 1. Wherein, elongated support member (12) is formed having open ends and support bracket (10) further includes removable closure means for enclosing each end of elongated channel (14). It is to be noted any type of closure means of engineering choice may be used, such as end caps (24) (only one shown) which may be easily frictionally engaged onto each open end of elongated support member (12). This proves to be very useful as this allows the user to install as many externally threaded attachment plugs (22) as they wish. Also, if one of the externally threaded attachment plugs (22) accidentally breaks or is simply faulty, the user can easily replace the plug in a simple convenient manner. Furthermore, each of the end caps (24) can be made from any suitable material of engineering choice that is durable, such as hard rubber, plastic, etc.

Figure 4:
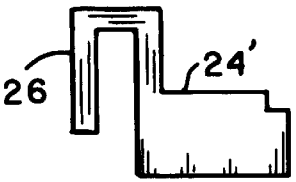
FIG. 4 is substantially an end view illustrating a variation of an end cap.

Referring now to FIG. 4, which depicts a variation or option for constructing each end cap (24'). Wherein, each end cap (24') can be integrally formed as one unit and includes a hook member (26) extending there from which not only provides additional strength and support for support bracket (10'), but also provides attachment means for attaching bracket (10') onto a support structure of user choice, such as onto a fence or the like. Again, this construction for the end cap (24') can easily be incorporated into the preferred embodiment and integrally manufactured from a plastic mold injection.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatus.

What we claim as new and wish to secure by letters patent is:

1. A support bracket for garden hose attachments comprising: an integrally formed elongated support member that is made from a plastic mold injection, said integrally formed elongated support member having upraised side walls running lengthwise which form an elongated channel, said elongated channel being of a shape and size to slidably and non-rotatably receive and retain means for threadably engaging internally threaded garden hose attachments, said means comprising multiple externally threaded ¾ inch PVC attachment plugs therein, said multiple externally threaded ¾ inch PVC attachment plugs having either a hexagonal or square shaped base, said integrally formed elongated support member having open ends and removable closure means that frictionally engage onto said open ends for enclosing each end of said elongated channel, wherein said removable closure means comprises end caps, each having an integrally formed hook member thereon to enable said elongated support member to be suspended, whereby said integrally formed elongated support member with said multiple externally threaded ¾ inch PVC attachment plugs in combination can threadably receive and slidably support multiple internally threaded garden hose attachments thereon.

* * * * *